US006244155B1

(12) United States Patent
Sparks

(10) Patent No.: US 6,244,155 B1
(45) Date of Patent: Jun. 12, 2001

(54) EXPLOSIVE PARCEL CONTAINMENT AND BLAST MITIGATION CONTAINER

(75) Inventor: Michael H. Sparks, Frederick County, MD (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/270,748

(22) Filed: Mar. 16, 1999

(51) Int. Cl.[7] ..... F42B 33/00
(52) U.S. Cl. ..... 86/50; 102/303
(58) Field of Search ..... 86/50; 102/303, 102/372

(56) References Cited

U.S. PATENT DOCUMENTS 4,727,789 * 3/1988 Katsanis et al. ..... 86/50
5,249,534 * 10/1993 Sacks ..... 102/303 X
5,301,594 * 4/1994 Argazzi et al. ..... 86/50
5,386,779 * 2/1995 Baker ..... 102/303
5,394,786 * 3/1995 Gettle et al. ..... 102/303 X
5,524,546 * 6/1996 Rozner et al. ..... 102/303
6,173,662 * 1/2001 Donovan ..... 86/50 X

* cited by examiner

*Primary Examiner*—Peter A. Nelson
(74) *Attorney, Agent, or Firm*—William R. Moser; Virginia B. Caress; Paul A. Gottlieb

(57) ABSTRACT

The present invention relates to a containment structure for containing and mitigating explosions. The containment structure is installed in the wall of the building and has interior and exterior doors for placing suspicious packages into the containment structure and retrieving them from the exterior of the building. The containment structure has a blast deflection chute and a blowout panel to direct over pressure from explosions away from the building, surrounding structures and people.

20 Claims, 3 Drawing Sheets

EXPLOSIVE PARCEL CONTAINMENT AND BLAST MITIGATION CONTAINER

BACKGROUND OF THE INVENTION

1. Field of the Invention

The present invention relates to a containment structure for containing and mitigating explosions from packages and parcels. In particular, the present invention relates to a containment structure, preferably formed as a box, installed in a wall of a building providing a receiving area where packages and parcels can be placed and any explosions from bombs in such packages and parcels could be contained and deflected away from the building and people.

2. The Prior Art

U.S. Pat. No. 3,054,555 to Saxon relates to a package delivery box structure and does not disclose an explosion containment unit.

U.S. Pat. No. 4,187,758 to Petty relates to a bomb containment device. This device is intended for transporting the bond within the device to another location rather than contain and mitigate any explosion within the device.

U.S. Pat. No. 4,401,037 is for a security transfer unintended to transfer money and other valuables and not for containing explosions.

U.S. Pat. No. 4,741,277 to Seltzer is for a door or window designed with bombardment inhibiting portions but is not intended to provide a receptacle area in a building for containing and mitigating an explosion from a package or parcel.

U.S. Pat. No. 4,640,550 to Cleary, Jr. is a tamperproof mailbox assembly designed to reduce mailboxes from being tampered with and broken into.

U.S. Pat. No. 5,060,582 to Salzer relates to a high security blast resistant door. This invention is not intended to provide a containment box in a building for parcels and packages containing explosives.

U.S. Pat. No. 5,249,534 to Sacks relates to a cover made of resistant material to bomb blasts but this invention is not designed to be an explosion containment unit in a building.

SUMMARY OF THE INVENTION

It is therefore a principal object of the invention to provide a containment structure for containing and mitigating explosives from packages received in a building.

It is further an object of the invention to provide a containment structure which deflects the explosion away from the building and people in the area. It is still another object to provide a containment structure shaped as a box with lockable door handles on the interior and exterior doors of the box.

It is yet another object to provide a box with a blast deflection chute and a blowout panel to deflect the force of the explosion away from the building and the people in the area.

These objects are realized in part by providing a box with a portion extending into a wall of the building to provide a receiving area for parcels and packages. The box has a portion extending out of the wall of the building and connected to a blast deflective chute with a blowout panel.

The portion of the box extending out of the wall has an exterior door and the floor of the box is sloped downwardly in a direction away from the building to provide for removal of packages and parcels received from the exterior door.

Other objects will become apparent from the foregoing description and accompanying drawings as set forth below.

DETAILED DESCRIPTION OF THE PREFERRED EMBODIMENTS

Figure 1:
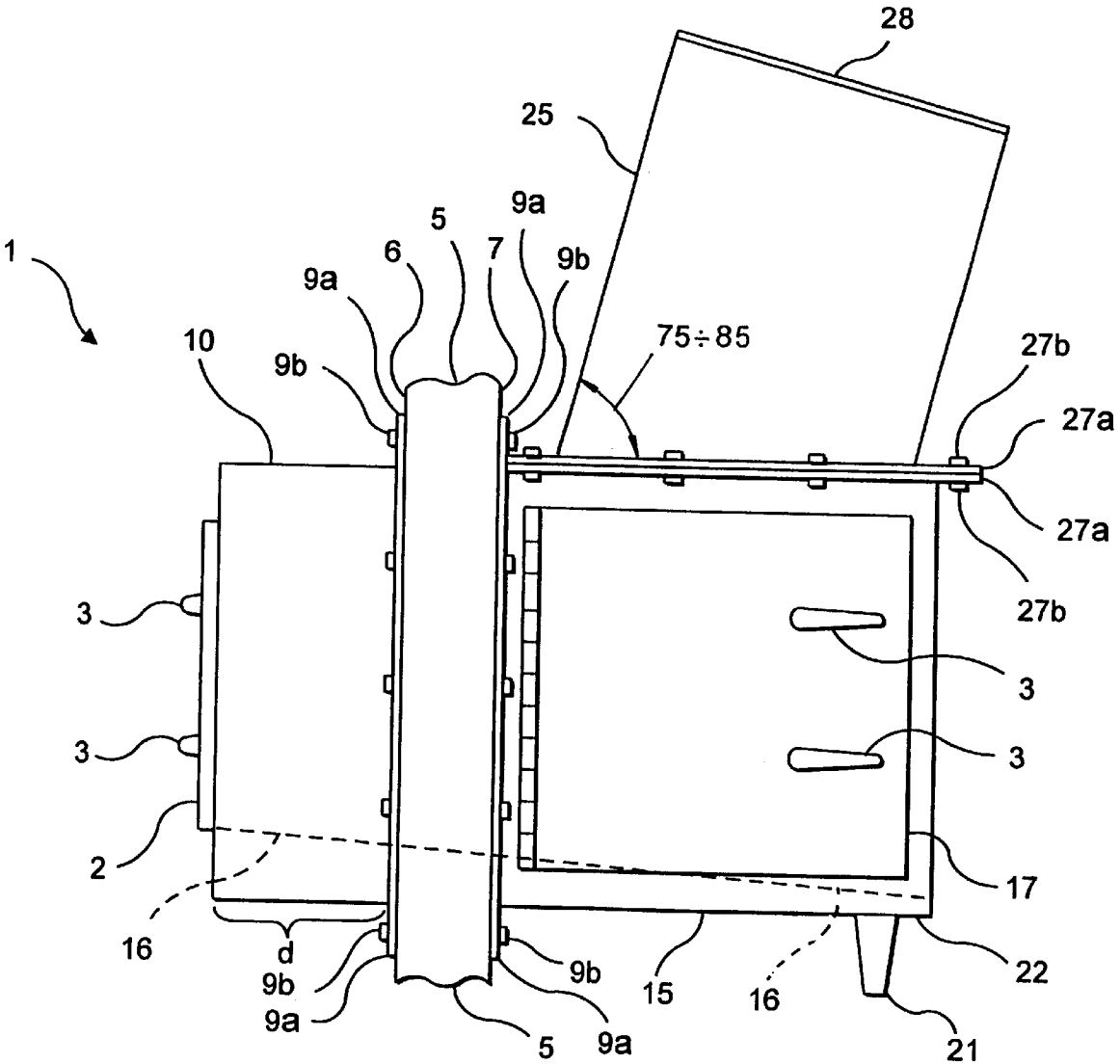
FIG. 1 is a sectional view of the invention.
Figure 2:
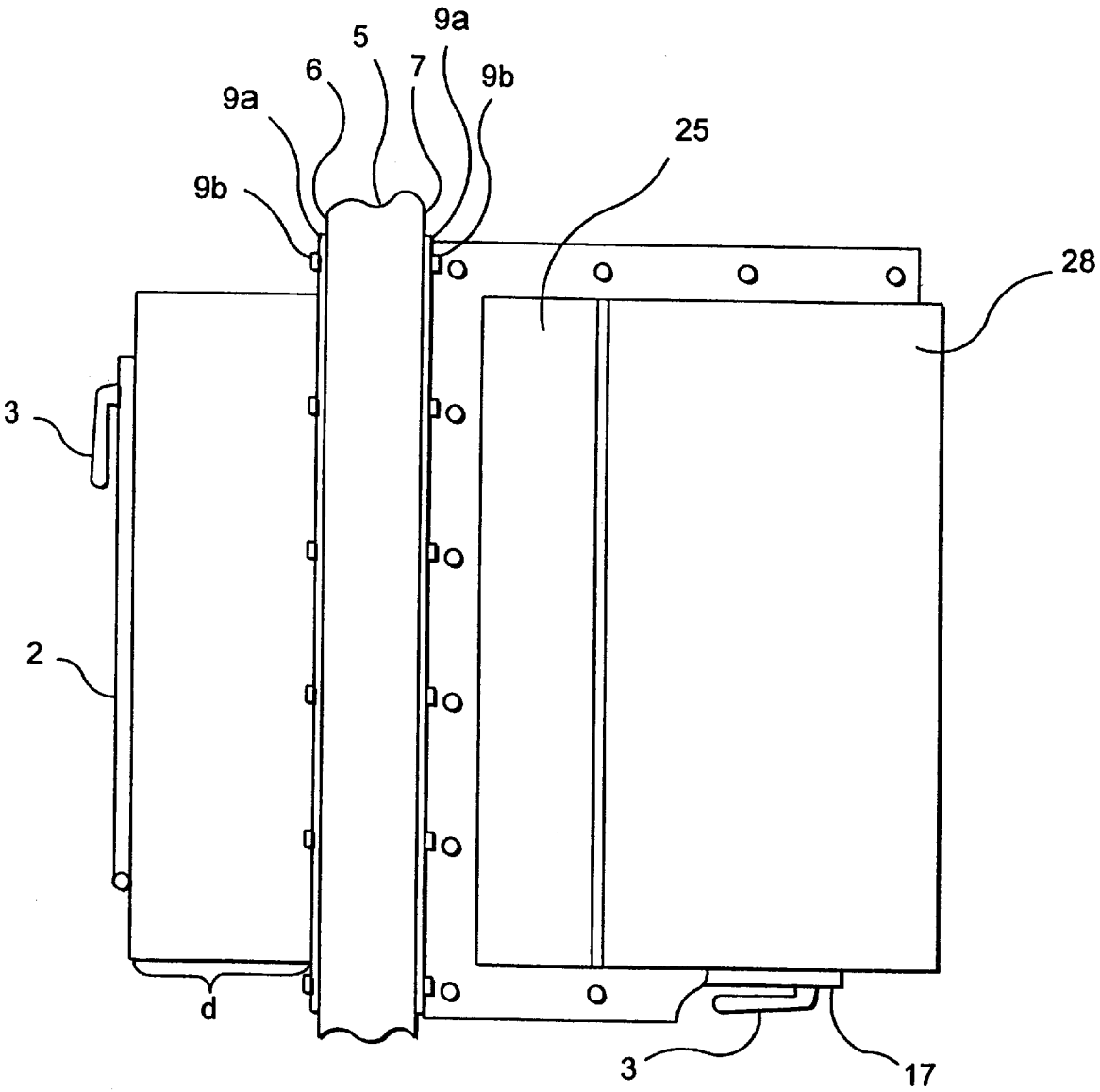
FIG. 2 is a top view of the invention.
Figure 3:
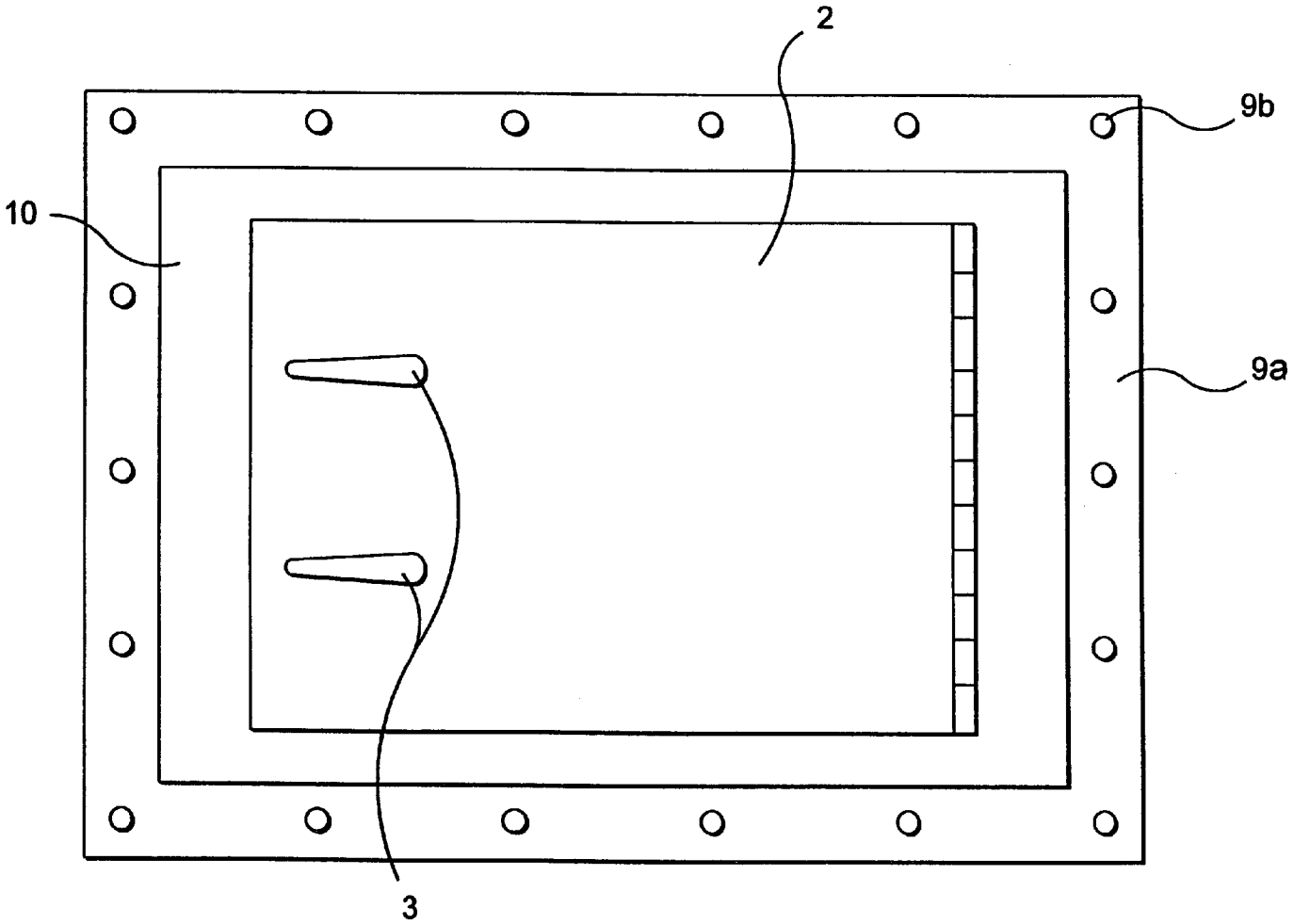
FIG. 3 is a view of one of the two doors of the invention.

Referring to FIG. 1–3 of the drawings and in particular FIG. 1 which illustrates a section view of the invention in which a containment structure preferably shaped and shown in FIGS. 1–3 as a box 1 extends through a wall 5 of a building.

The box 1 has a first portion 10 which extends through the wall 5 into the building providing a receiving area for parcels and packages accessed by a door 2. The door has two handles 3 which can be locked to deny access when appropriate.

The box 5 is preferably connected by flanges to the wall 5 on both the interior 6 and exterior 7 sides of the wall 5 of the building by flanges 9*a* and bolts 9*b* and other mounting hardware. Preferably metal flanges 6 to 8 inches are used.

The box 1 has a receiving area in the interior of the building for receiving packages by means of an interior door 2 which is preferably located a distance of eight (8) inches away from the interior surface 6 of the walls of the building. The interior door 2 permits packages and parcels to be placed thereon or retrieved from within the building. The interior door 2 preferably has two handles and these two handles are preferably locking handles to securely lock any suspicious packages and parcels which might contain explosives within the box 1. The locking handles are similar to those used in an encased woodstove. The box 1 will also have a similar apparatus and fabrication to that of a woodcase stove. The size of the interior door may vary in design for providing access to various sized parcels.

The box 1 has a second portion 15 flanged to the exterior surface 7 of the wall 5 which extends outside of the building. The box preferably has a bottom surface 16 which is inclined at a downwardly sloping toward the second portion 15 so that parcels can slide from the interior door 2 to an exterior door 17 located on the second portion 15 of the box 1. The exterior door 17 provides access to the box 1 from outside the building so that suspicious packages and parcels placed on the box 1 through the interior door 2 can be removed from the exterior door. The exterior door 17 is fabricated and connected to the second portion 15 of the box in the same way as described previously for the interior door and the first portion 10 of the box 1 and as shown in FIG. 3.

The bottom surface 16 of the floor can include a roller assembly such as rollers (not shown) or alternatively ball bearings (not shown) for conveying the packages or parcels to the second portion of the box which is outside of the building.

The second portion 15 of the box 1 preferably has a pair of legs 21 at its end area 22 to support the weight of portion 15. The pair of legs 21 are preferably made of steel and bolted to the box 1.

A blast deflection chute 25 is connected preferably by flanges 27*a* and bolts 27*b* to the second portion 15 of the box 1 and has an end terminating in a blowout panel 28. The blast deflection chute 28 and the blowout panel 28 direct over pressure from an explosive discharge away from the building and into an area where the potential damage to people and structures is minimized and hopefully avoided.

The blast deflection chute 25 is mounted on the top surface of portion 15 and is angled away from the exterior wall to direct blast over pressure upward. The angle can vary based upon the environment surrounding the building. The preferred angle is 75 degrees from the top surface of section 15 or 15 degrees from exterior wall 7.

The length of the chute 25 will also vary accordingly based on environmental location considerations of where the building is located. The blast deflection chute 25 is preferably formed of a pipe which is flanged to the box 1 as shown in FIGS. 1 and 2.

The blowout panel 28 is preferably made of plastic material or fiber material so that it does not provide any harmful debris if it fragments due to the explosions. The function of the blowout panel is to provide environmental protection for the interior of portions 1 and 25.

In operation, suspicious packages or parcels which may contain explosive materials or bombs will be placed inside interior door 2 of the box 1 and the interior door 2 will be locked by the locking handles 3. Any explosive parcel will then either slide down the sloping floor 16 of the box 1 or roll by rollers or ball bearing through wall 5 to the exterior side of the building and the second section 15 of the box 1 to the exterior door 17 where the parcel or package will be removed and immediately safely transported away by the appropriate authorities such as a police explosive ordnance disposal unit. In the event that the parcel explodes the box is designed to direct the explosion, away from the building and people in the area, upwardly through the blast deflection chute 25 and blowout panel 28 which will further serve to mitigate the force of the explosion.

It is understood that while the box 1 has been described as having a first portion and a second portion, that the box or other shaped containment structures are preferably formed as unitary structures. It is further understood that while this containment and explosion mitigation structure has been preferably described as a box, the invention is not limited to any specific geometric shape and structure.

The invention may also be described as an explosive parcel containment and blast mitigation container having sides which 10 define a space for containing and transferring a parcel and which form openings in the interior and exterior sides of a wall of a building and a space therebetween through which a parcel may be transferred from said interior opening to said exterior opening, said interior opening having a lockable door for receiving a parcel, said exterior opening having sides extending beyond the exterior wall of the building, a door being located in a least one of said sides for removing a parcel, and a blast deflector being located on at least one of said sides or at the end of the space defined by said sides, said blast deflector comprising an enclosed space having a blowout panel for releasing explosive gases in the event of an explosion.

Said blast deflector preferably is pointed upward, and said blowout panel is selected from the group consisting of a hinged door panel, a panel comprised of a material which will separate when subjected to pressure, and a panel which will be blown out of said blast deflector in an explosion.

I do not limit myself to any particular details or constructions set forth in this specification illustration in the drawings as the same of what is only certain by invention and it is observed that the same may be modified without departing from the spirit or the scope of the claimed invention.

Having thus described the invention, what is claimed as new and desired to be secured by Letters Patent is as follow:

1. A containment structure for containing and mitigating a blast from an exploding parcel installed into a wall from a parcel/package receiving area to an exterior of a building, comprising:

said containment structure having a first portion extending into a wall of a building and having a door to provide a receiving area inside of said building for parcels and packages;

said containment structure having a second portion, extending out of said wall externally, entirely outside of said building, said second portion having an external surface connected to a blast deflection chute, said blast deflection chute extending upwardly at an angle from said external surface of said second portion of said containment structure and said chute terminating in a blowout panel so as to direct over pressure from an exploding package away from said building and out through said blowout panel to minimize potential damage to people and structures.

2. The containment structure according to claim 1 wherein said containment structure is formed as a box.

3. The containment structure according to claim 1 wherein said second portion of said containment structure has a door to provide exterior receiving area for parcels and packages outside of said building.

4. The containment structure according to claim 1 wherein said chute is angled at 75° from said exterior top of said second portion.

5. The containment structure according to claim 1 wherein said second portion has a top surface and said chute is mounted on said top surface of said second portion and is angled away from said exterior of said second portion.

6. The containment structure according to claim 1 wherein said first portion includes a floor sloping downwardly in a direction away from said first door.

7. The containment structure according to claim 1 wherein said door of said first section and said door of said second section each have handles which can lock each said door.

8. The containment structure according to claim 1 wherein said chute is formed of a pipe.

9. The containment structure according to claim 1 wherein said chute is connected to said second section by flanges.

10. The containment structure according to claim 1 wherein said blowout part is made of plastic material.

11. The containment structure according to claim 1 wherein said blowout part is made of fiber material.

12. The containment structure according to claim 1 wherein said downwardly sloping floor is sloped at an angle of 10°.

13. The containment structure according to claim 1 wherein said downwardly sloping floor has rollers to convey packages and parcels toward said blast deflection chute of said containment structure.

14. The containment structure according to claim 1 where said downwardly sloping floor has ball bearings to convey packages and parcels toward said blast deflection chute of said containment structure.

15. The containment structure according to claim 1 wherein said containment structure is attached to wall of the building by means of steel brackets and flanges on both interior and exterior sides of said wall.

16. The containment structure according to claim 1 wherein said containment structure is manufactured of strong blast insulative material.

17. The containment structure according to claim 1 wherein said second portion of said containment structure includes a pair of legs at an end near said blast deflection chute.

18. The containment structure according to claim 1 wherein said pair of legs are made of steel and bolted to said second portion of said containment structure.

19. An explosive parcel containment and blast mitigation container having sides which define a space for containing and transferring a parcel and which form openings in the interior and exterior sides of a wall of a building and a space therebetween through which a parcel may be transferred from said interior opening to said exterior opening, said interior opening having a lockable door for receiving a parcel, said exterior opening having sides extending beyond the exterior wall of the building, a door being located in a least one of said sides for removing a parcel, and a blast deflector being located on at least one of said sides or at the end of the space defined by said sides, said blast deflector comprising an enclosed space having a blow-out panel for releasing explosive gases in the event of an explosion.

20. An explosive parcel containment and blast mitigation container of claim 19 wherein said blast deflector is pointed upward and said blowout panel is selected from the group consisting of a hinged door panel, a panel comprised of a material which will separate when subjected to pressure, and a panel which will be blown out of said blast deflector in an explosion.

* * * * *